US006599334B1

(12) United States Patent
Anderson

(10) Patent No.: US 6,599,334 B1
(45) Date of Patent: Jul. 29, 2003

(54) SOYBEAN WAX CANDLES

(76) Inventor: Jill M. Anderson, 121 E. Flynn St., Redwood Falls, Redwood, MN (US) 56283

( * ) Notice: Subject to any disclaimer, the term of this patent is extended or adjusted under 35 U.S.C. 154(b) by 0 days.

(21) Appl. No.: 09/752,979

(22) Filed: Dec. 29, 2000

Related U.S. Application Data

(60) Provisional application No. 60/199,505, filed on Apr. 25, 2000.

(51) Int. Cl.[7] ..... C11C 5/00
(52) U.S. Cl. ..... 44/275; 431/288
(58) Field of Search ..... 44/275; 431/288

(56) References Cited

U.S. PATENT DOCUMENTS

| | | | | | |
|---|---|---|---|---|---|
| 1,954,659 | A | | 4/1934 | Will | |
| 1,958,462 | A | | 5/1934 | Baumer | |
| 2,290,393 | A | | 7/1942 | Thomas | |
| 2,551,638 | A | | 5/1951 | Seger et al. | |
| 2,807,524 | A | | 9/1957 | Tench | |
| 2,937,129 | A | | 5/1960 | Garwood | |
| 3,048,551 | A | | 8/1962 | Lutz | |
| 3,312,648 | A | | 4/1967 | Guttman et al. | |
| 3,411,855 | A | | 11/1968 | Olund | |
| 3,645,705 | A | | 2/1972 | Miller et al. | |
| 3,758,532 | A | * | 9/1973 | Gibble | |
| 3,772,233 | A | | 11/1973 | Gaab et al. | |
| 3,844,706 | A | | 10/1974 | Tsaras | |
| 4,008,251 | A | | 2/1977 | Moore et al. | |
| 4,049,893 | A | | 9/1977 | Kidwell, Jr. | |
| 4,060,569 | A | | 11/1977 | Woods et al. | |
| D249,588 | S | * | 9/1978 | Tanikawa | D26/1 |
| 4,239,546 | A | | 12/1980 | Russel et al. | |
| 4,614,625 | A | * | 9/1986 | Wilson | 431/288 |
| 4,855,098 | A | * | 8/1989 | Taylor | 431/288 |
| 5,171,329 | A | | 12/1992 | Lin | |
| 5,338,187 | A | | 8/1994 | Elharar | |
| 5,597,300 | A | * | 1/1997 | Wohl et al. | 431/288 |
| 5,766,628 | A | * | 6/1998 | Nurnberg | 424/450 |
| 5,843,194 | A | | 12/1998 | Spaulding | |
| 5,849,375 | A | | 12/1998 | Smith et al. | |
| 5,871,553 | A | | 2/1999 | Spaulding | |
| 5,879,694 | A | | 3/1999 | Morrison et al. | |
| 6,063,144 | A | | 5/2000 | Calzada et al. | |
| 6,214,918 | B1 | * | 4/2001 | Johnson | 44/275 |

OTHER PUBLICATIONS

"Purdue Students Put the 'Happy' Back Into Birthday Candles", HTTP;//www.ilsoy.org/96news/candles.html, Sep. 26, 2000, 2 pages.

* cited by examiner

*Primary Examiner*—Margaret Medley
(74) *Attorney, Agent, or Firm*—Roper & Quigg

(57) ABSTRACT

A solid fuel candle which is highly adapted for use both in a container and also as a free-standing candle includes at least 85 percent hydrogenated soybean oil, approximately 0 to 4 percent synthetic wax composition, approximately 0 to 4 percent of a second hydrogenated vegetable or petroleum oil, approximately 0 to 10 percent fragrance or scent, and approximately 0 to 3 percent dye. The hydrogenated vegetable oil most preferably has an iodine value of approximately 50 and a melting point of approximately 125 degrees Fahrenheit, with a free fatty acid content of less than one-tenth of one percent. The synthetic wax composition is most preferably formed from alpha olefin monomers and oligomers under free radical conditions at relatively low pressures to yield a highly branched polymer wax having congealing and melting points lower than the starting alpha olefin material and a higher molecular weight.

17 Claims, 1 Drawing Sheet

SOYBEAN WAX CANDLES

This application claims priority to U.S. Provisional Application Ser. No. 60/199,505 filed Apr. 25, 2000.

BACKGROUND OF THE INVENTION

1. Field of the Invention

This invention pertains generally to the field of fuel and related compositions. More specifically, the present invention pertains to candle compositions formed in substantial part from hydrogenated soybean oil. The candle compositions of the present invention utilize renewable resources, produce no soot, and are directly applicable to container candles, votive candles and the like.

2. Description of the Related Art

The human association with fire extends quite likely to the earliest days of man. Throughout recorded history man has utilized the energy released during combustion for a variety of purposes. It would be safe to presume that the earliest uses of fire were likely derived from relatively uncontrolled burning of large combustible materials such as branches and logs. Certainly lighting, heating and cooking would have been contemplated almost from the first encounter with fire.

As with all other products of human ingenuity, the use and applications for combustion have expanded from the basic lighting, heating and cooking into many highly refined and diverse technologies. Motive power, such as derived from internal and external combustion engines, and decorations, such as derived from luminaries and candles, are representative of the diverse applications for combustion that have been refined through time. As humans have better learned to control combustion, the numbers of applications for the technology have expanded. Similarly, techniques for combustion have become more specific or limited in the number of applications which are best suited for the given technique.

Candles, such as the subject of the present invention, use a combination of fuel and wick to produce both heat and light. The use of a solid fuel is advantageous in many applications, since the solid fuel normally requires little or no safety precautions. Consequently, a solid fuel candle may be purchased and safely transported and stored, occasionally being left on a shelf for many years with little or no degradation or hazard. During use, there is little risk of uncontrolled fire, since the fuel does not burn separate from the wick. In contrast, a liquid fuel source may be spilled or may leak, and the liquid fuel at once becomes a tremendous fire hazard.

At one time, the relative stability and safety of solid fuel candles led to widespread use in lighting applications. Nevertheless, with the introduction of electric lighting, most general-purpose illumination is not derived from candles. However, in locales or situations where electric power is unavailable, candles continue to provide a significant source of illumination. The solid fuel may be designed to burn either relatively slowly or relatively quickly, depending upon the intensity and flame size which is desired, and total desired time for illumination from a single candle. The rate of combustion is, however, limited to the extent that combustion will not be sustained outside of the wick, so that the candle body will not ignite in its entirety.

When a candle uses a solid fuel, the candle flame is used to melt the solid fuel so that the fuel may pass through capillary action into the wick and be drawn into the flame. If the solid fuel melts too quickly, the resultant liquid may drown and extinguish the flame. Yet, if the solid fuel melts too slowly, the flame may consume the wick without burning solid fuel spaced away from the wick. Furthermore, the viscosity of the molten solid fuel must be low enough to allow the molten fuel to flow towards the wick and then be drawn by capillary action. Furthermore, the flame will desirably burn cleanly so as to not coat container walls or surroundings with soot. In addition, when the candle is produced or placed within a container, the solid fuel will desirably melt cleanly away from the container walls as the candle bums.

A solid fuel candle must not only have carefully controlled melting and combustion properties, but must also have satisfactory physical properties for an intended application. For example, a solid fuel candle will most preferably accommodate moderate variations in temperature without sagging, cracking or otherwise physically degrading. Furthermore, the solid fuel will most preferably be stable for extended periods of time and under diverse atmospheric conditions. The candle will most preferably not have air bubbles entrained within the wax, and will have a smooth and consistent exterior, free from irregular spots or inconsistent appearance. The many physical characteristics required of the solid fuel simply to bum in cooperation with the candle wick illustrate the level of complexity and technology which has gone into the development of candles over the years. Nevertheless, there have been more refinements which create further demands upon a candle designer.

A soft, warm glow is generated by a candle, with an inherent characteristic flicker. This unique source of illumination is used in a variety of applications to help create an intended mood or atmosphere. In fact, the gentle dancing glow from a candle attracts a person's attention and may hold it for an extended period of time, often having a relaxing or soothing effect upon the person. The wick is used to draw fuel into a burning flame in relatively controlled and predictable way, but various air currents influence the size and direction of flame, thereby leading to the dancing effect. Various wicks have been developed that may provide different capillary effect, and through the use of different additives, may provide different colors and intensities of flame. Consequently, candles are frequently used during religious ceremonies, celebrations and festivities, for relaxation, and to create an intimate or romantic setting.

Owing to the smaller size of candles, the heat which is generated is only infrequently the purpose for burning a candle. Nevertheless, the heat can be used not only for illumination but also for the dispersion of various materials and compounds into the air. The same air currents that tend to cause a candle flame to dance will also ensure substantial dispersion, or throw, of scents and other compounds into the air. Consequently, candles may be used for these applications as well. It is important that the candle not produce an unpleasant or undesirable aroma during combustion, and that the intended aromas and scents not be masked or altered by the smell of the combustion of the candle fuel.

Early candles were manufactured from fuel sources which were available in nature. Such materials included waxes and oils such as olive oil, bees wax, spermaceti and tallow. With the refinement of petroleum products came lower cost paraffin, which quickly replaced natural ingredients in the production of most candles. Unfortunately, paraffin produces soot and smoke and tends to have an unpleasant odor during combustion, and also softens and sags during warm storage. Progress has been made to address the undesirable characteristics of paraffin through the addition of various ingredients and additives. Nevertheless, paraffin is derived from a nonrenewable resource, and regardless of purity, still produces soot.

Recently, there have been several attempts to manufacture candles made from soybean oil. Soybean oil offers several attractive benefits including relatively large quantities of oil found therein, the use of a renewable resource produced through agriculture, elimination of paraffin, and elimination of associated soot. The Indiana Soybean Board has sponsored an "Innovative Uses for Soybeans" contest in association with Indiana's soybean checkoff organization and Purdue University. In 1996, a group of students from Purdue University developed an innovative soybean-oil-based candle which is composed of 83 percent hydrogenated soybean oil, 16 percent glycerol, about 1 percent coloring, and a touch of peppermint flavoring. This composition, which was designed for edible birthday candles, was then passed through commercial development for implementation in container candles. At the time of this filing, the commercially developed composition is believed to be 70 percent soybean oil and 30 percent tallow.

Another example of recent candle making is illustrated by Calzada in U.S. Pat. No. 6,063,144, incorporated herein by reference. Therein, a non-paraffin combustible candle composition is illustrated as having at least 30 parts by weight stearic acid, at least five parts by weight vegetable derived wax having a melting point of at least 50 degrees Centigrade, 0 to 50 parts by weight of at least one vegetable oil, 0 to 10 parts by weight of at least one fragrance and 0 to 1 part by weight of at least one oxidation inhibitor. Stearic acid, according to Calzada, may describe so-called hydrogenated tallow fatty acids as well as "true" stearic acid products. Stearic acid is illustrated throughout the prior art as an excellent additive for use with paraffin candles. Nevertheless, the relatively large proportions of stearic acid or tallow are undesirable, where an agriculturally-based, renewable plant source would be preferred.

In another specialty area of candle making, that off the transparent candle, there has also been a considerable effort towards refining basic ingredients. Morrison et al. in U.S. Pat. No. 5,879,694 illustrates transparent stiff gel candles utilizing hydrocarbon oil and one or more triblock, radial block or multi-block copolymers of thermoplastic rubber, while Spaulding in U.S. Pat. No. 5,843,194 and Miller et al in U.S. Pat. No. 3,645,705 disclose amide gelling agents together with various alcohols or acids. The materials illustrated in Spaulding. Miller et al and Morrison et al. constitute in large part ingredients manufactured from non-renewable resources.

Lin in U.S. Pat. No. 5,171,329 describes a butter oil candle such as might be used, for example, in association with the practice of Buddhism. That composition illustrates a blend of liquid butter oil together with a solidified oil having an iodine value below 2. Tench, in U.S. Pat. No. 2,807,524 illustrates the addition of bis-cyclopentadienyl iron to wax compositions to reduce soot formation. Gaab et al in U.S. Pat. No. 3,772,233 teach the incorporation of alpha olefins as an alternative to stearic acid. The proportions and characteristics are similar, including at least 10 percent alpha olefin, and the alpha olefins are used where the stearic acid would normally be, to serve as a carrier and dispersant for pigments and enhance mold release properties, burning qualities, hardness and opacity.

In much earlier work, prior to the development of the large petrochemical industry, efforts were directed towards the incorporation of agriculturally-based sources for waxes and oils, many primarily for religious purposes. For example, Will in U.S. Pat. No. 1,954,659 describes candles having 51 percent hydrogenated vegetable oil mixed with 49 percent paraffin, stearic acid, beeswax or other wax, where the objective is to use at least 50 percent vegetable oil in a solid self-sustaining form for use in rubrics. Similarly, Baumer in U.S. Pat. No. 1,958,462 illustrates a form sustaining candle having at least 20 percent beeswax and a balance liquid or hydrogenated vegetable oil. According to Baumer, elimination of beeswax requires complete saturation through hydrogenation, and consequently yields an unduly brittle candle.

Each of these aforementioned patents, the contents of each which are incorporated herein by reference for their respective teachings of candle making and candle compositions, fail to disclose or teach a commercially viable candle composition composed almost entirely of vegetable-derived source material which burns cleanly and satisfactorily. Consequently, and as has been enumerated throughout the patents, the belief that it is not possible to produce satisfactory candles having desirable characteristics from nearly 100 percent vegetable derived oils is not accurate, but instead represents biases that the present inventor has seen beyond. It has long been desirable to expand the utility of the vegetable-based solid fuel candles, for as many beneficial applications as possible and with as great a percentage agriculturally renewable materials as possible, without sacrificing the characteristics inherent in a high-quality candle. The present invention accomplishes this and other objectives.

SUMMARY OF THE INVENTION

In a first manifestation, the invention is a candle wax composition consisting essentially of at least 85 percent partially hydrogenated soybean oil having an iodine value of between 49 and 53 and a melting point of between 122 and 128 degrees Fahrenheit; 0 to 4 percent synthetic wax formed by polymerizing alpha olefins under free radical conditions to form a highly branched polymer; 0 to 4 percent secondary oil; 0 to 10 percent fragrance; and 0 to 3 percent dye.

In a second manifestation, the invention is a novel container candle. A container has an opening for receiving and retaining a fuel composition, whether in solid or liquid form. A solid fuel composition within the container consists essentially of at least 85 percent partially hydrogenated soybean oil, synthetic wax formed from alkylene monomers or oligomers, and a remainder of fragrance and dye. A wick protrudes from the solid fuel composition towards the container opening.

In a third manifestation, the invention is a solid fuel composition suitable for use in container candles, votive candles and free-standing candles. The solid fuel comprises at least 89 percent of a combustible component which is flammable within a wick in the presence of a flame but which will not sustain combustion on a surface independent of the wick. The combustible component consists of at least 95 percent partially hydrogenated soybean oil, and a balance synthetic wax. The remainder of the composition is selected from fragrance, dye, and additives.

OBJECTS OF THE INVENTION

A first object of the invention is to provide a candle manufactured from a renewable resource, most preferably entirely of plant origin. A second object of the invention is to provide a candle composition which bums cleanly, without the production of soot. A third object of the invention is to provide a candle composition which may be used in a container, and which will melt cleanly away from the container walls. A further object of the invention is a single candle composition which is directly applicable to container candles, votives and self-supporting designs, and which will accommodate moderate variations in temperature and environment without sagging, cracking or otherwise physically degrading. An additional object of the invention is to provide a composition which may be formed without air bubbles entrained within the wax, and which will have a smooth and consistent exterior free from irregular spots or inconsistent appearance. Another object of the invention is to provide a solid fuel candle composition that may be safely transported and stored for many years, and which does not degrade or present a fire hazard. An additional object of the invention is to expand the utility of the candle composition, to allow the composition to contain various additives including scents and aromas, colorants and other similar additives. Yet a further object of the invention is to provide a candle composition that does not produce an unpleasant or undesirable aroma while burning. These and other objects are achieved in the present invention, which may be best understood by the following detailed description and drawing.

DESCRIPTION OF THE PREFERRED EMBODIMENT

Figure 1:
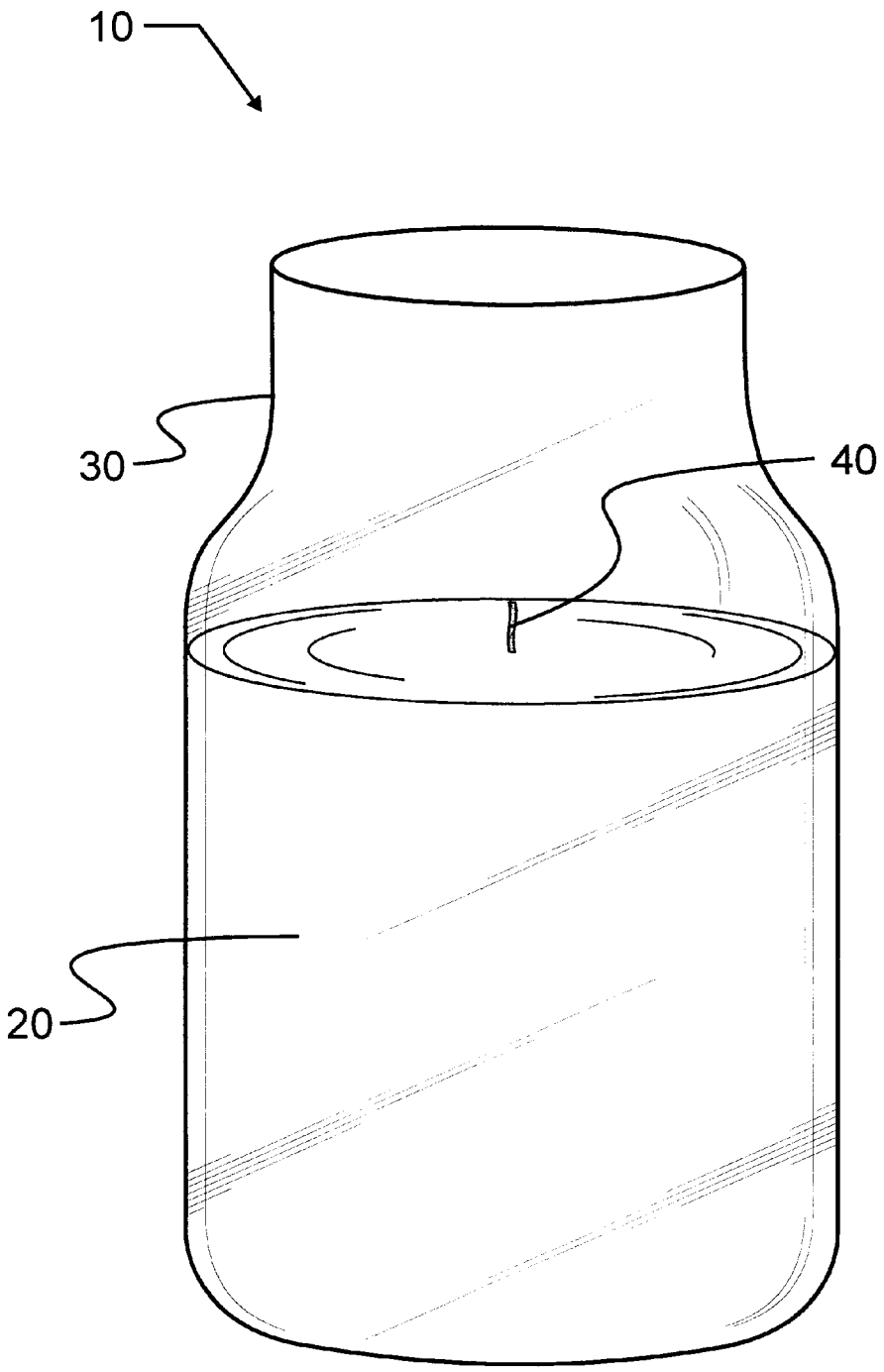
FIG. 1 illustrates an exemplary container candle including wax compositions created in accord with the teachings of the present invention.

The preferred embodiment candle composition will include at least 85 percent hydrogenated vegetable oil, approximately 0 to 4 percent (for example 0.001 percent), alpha olefin synthetic wax composition, approximately 0 to 4 percent of a second hydrogenated vegetable or petroleum oil, approximately 0 to 10 percent fragrance or scent, and approximately 0 to 3 percent dye. The exact content of the fragrance and dye are not critical to the performance of the invention, but will instead be determined at the time of formulation by those reasonably skilled in the candle-formulating art.

Vegetable-derived oils provide a rich source of energy that has only recently met with renewed interest. These oils are, in their naturally pressed or extracted state, liquid. While some artisans have manufactured candles from these liquid forms, as noted herein above in the background section of this specification the liquid form is generally undesirable for the manufacture of candles, owing primarily to the inherent flammability of the liquid and the risk for unintentional release and consequent spread of fire.

In order to better capture the utility of these oils, it has been known heretofore to hydrogenate the vegetable liquid, to produce varying degrees of solidification or hardness. The most preferred vegetable oil which is suitable for use in the preferred embodiment is soybean oil, also referred to as soya oil in some references. The oil will typically be refined to remove undesirable impurities, bleached, and then hydrogenated. The process of hydrogenation may be carried out in a hydrogen environment, typically at elevated temperatures as from 400 to 700 degrees Fahrenheit, under pressure, in the presence of a hydrogen catalyst such as nickel. While other catalysts have been used to accomplish the hydrogenation and may be suitable in the practice of the present invention, nickel is most preferred. The hydrogen will preferably be mixed with the oil, either by mechanical agitation or through various jets or bubblers which effectively pass the hydrogen through the vegetable oil. As the oil is progressively hydrogenated, its properties are monitored for optimum values and characteristics. Among these are the iodine value, which in the preferred embodiment will be between approximately 49 and 53 with one embodiment having a preferred iodine value of 51, and the Mettler melting point, which will range between 122 and 128 degrees Fahrenheit. Preferably there will be less than 0.1 percent free fatty acids after hydrogenation. Once the hydrogenation is complete, the catalyst will be removed, the oil will be cleaned and purified, and the oil may again be bleached. It is important to note here that, contrary to commonly held beliefs regarding suitable compositions, the soybean oil referred to herein is not isolated to yield a soybean stearine as an attempt to substitute for or alternative to stearic acid. Instead, the preferred ingredient is quite surprisingly a shortening stabilizer. A most preferred source for this material is ACH Food Companies of Memphis, Tennessee, and the most preferred oil is sold under the trademark Shurset 125, as a food grade additive for icing, glaze and extruded pastries.

In addition to this first hydrogenated vegetable oil, a small amount of synthetic wax has been found to offer some benefit in some embodiments. A most preferred material is a hydrocarbon polymer of alpha olefins, polymerized or copolymerized in the presence of free radicals at low pressures. The resultant hydrocarbon polymers are highly branched, and have increased molecular weight, higher viscosities, and greater hardness but lower melting and congealing points than the original alpha olefins from which they are derived. An iodine value of approximately 15, with a melting point of approximately 124 degrees Fahrenheit has been found to be satisfactory, though other suitable materials having slightly different characteristics and melting points may be determined in light of the present teachings. The preferred synthetic wax may help to increase the opacity of the candle, bind and disperse fragrance oils throughout the candle composition, harden the candle, reduce the formation of air bubbles, and inhibit mopping of the candle. Color quality of the candle will typically be improved by the addition of the preferred synthetic wax. A most preferred material is sold under the trademark Vybar-260 by Baker Petrolite, and is described in much greater detail in U.S. Pat. No. 4,060,569 to Woods et al. and U.S. Pat No. 4,239,546 to Russell et al, the contents of each which are incorporated herein by reference. The use of Vybar is not new in the candle-making industry, and the latter patent discusses the application of Vybar specifically thereto. However, that patent teaches the use of Vybar at much higher levels, and in combination with paraffin as opposed to the particular preferred soybean oil of the present invention.

A second hydrogenated vegetable or petroleum oil may be incorporated, ranging from approximately 0 to 4 percent of the total. Ingredients such as Crisco brand shortening, a partially hydrogenated soybean oil, and Vaseline brand petroleum jelly have been tested. These ingredients are used to soften the candle, lower the melting point of the candle, and increase the throw of fragrance or scent. However, these materials are not used in the most preferred embodiment, and they readily yield undesirable smoke and soot.

Fragrance oils or various scents may be incorporated in amounts ranging from approximately 0 to 10 percent, the exact amount dependent upon the exact fragrance or scent and the compatibility with the primary ingredients. Oils are most preferred, as they are typically readily miscible with the waxes of the invention and are also readily dispersed into the air by the candle. Nevertheless, the invention is not confined to a particular fragrance or scent, nor an exact percentage, the amount which will instead be readily determined by those skilled in the art at the time of candle formulation.

Dyes may also be incorporated, typically in amounts ranging from approximately 0 to 3 percent. Once again however, the amount will depend upon the exact composition of the dye and its compatibility with the other candle ingredients.

The composition is manufactured by first melting the hydrogenated soybean oil, synthetic wax, and, if used, a second hydrogenated oil together at a temperature ranging from approximately 120 to 200 degrees Fahrenheit. To this molten oil and wax is added the fragrance and dye, and the resulting composition mixed thoroughly. While still molten, blend 20 will then be poured into container 30 and cooled therein until solidified. Wick 40 may be inserted either prior to pouring, during pouring, or inserted subsequent to cooling as is variously taught in the art. Furthermore, while container candle 10 is illustrated as being most preferred, owing to the significant demands placed upon this candle form that are not found in other candles, it will be apparent to those skilled in the art that the present composition may also be poured into other forms, containers or molds to produce other candles, including free standing types and votive candles.

EXAMPLE I 48 ounces by weight of Shurset 125 are combined with 0.4 ounces of Vybar-260 and melted and mixed, to yield a preferred combustible component.

EXAMPLE II

To the molten combustible component of example I, 3 ounces of fragrance oil is added and mixed, to yield a scented candle wax composition.

EXAMPLE I

To the scented candle wax composition of Example II a trace of dye, normally less than 0.05 ounces, is added to obtain a colored and scented candle wax composition.

The use of synthetic wax in paraffin candle compositions is, as aforementioned, not new, but, surprisingly, the quantity required in association with the most preferred hydrogenated soybean oil is a much smaller percentage than heretofore believed necessary, if used at all. Furthermore, the resulting candle wax composition is almost entirely composed of soybean oil, ranging from at least 85 percent to 100 percent, and the combustible composition has better than 99 percent soybean oil in the examples. The much higher percentages found herein significantly overshadow the previous attempts to formulate candles from soybean oil, and provide not only a higher quality candle but also a new outlet for soybeans produced by soybean growers. The preferred embodiment composition fulfills the objectives of the present invention, including no formation of soot upon the walls of candle containers, and the use of an agriculturally renewable plant-based resource.

Having thus disclosed the preferred embodiment and alternative ranges for the components of the present invention, additional possibilities and applications will become apparent without further discussion. Other materials having similar but differing properties and characteristics may be determined by those skilled in the art, upon a reading of the present disclosure, to have satisfactory benefit. The use of slightly varying melting points and percentages, while not deviating from the ranges illustrated above, may be used to optimize the composition for a particular application or purpose. While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A candle wax composition consisting essentially of:

at least 85 percent partially hydrogenated soybean oil having an iodine value of between 49 and 53 and a melting point of between 122 and 128 degrees Fahrenheit;

0.001 to 4 percent synthetic wax formed by polymerizing alpha olefins under free radical conditions to form a highly branched polymer;

0 to 4 percent second hydrogenated vegetable or petroleum oil 0 to 10 percent fragrance; and 0 to 3 percent dye.

2. The candle wax composition of claim 1, wherein said synthetic wax has an iodine value of approximately 15.

3. The candle wax composition of claim 2 wherein said synthetic wax is Vybar.

4. The candle wax composition of claim 1 wherein said partially hydrogenated soybean oil is Shurset 125.

5. The candle wax composition of claim 1 consisting essentially of at least 93 percent partially hydrogenated soybean oil.

6. The candle wax composition of claim 5 having at least 93 percent partially hydrogenated soybean oil, not more than 0.8 percent synthetic wax, and a balance fragrance and colorant.

7. A container candle comprising:

a container within which a fuel composition will be retained, whether in solid or liquid form, and having an opening therein;

a solid fuel composition consisting essentially of at least 85 percent partially hydrogenated soybean oil having an iodine value of between 49 and 53, at least 0.001 percent synthetic wax formed from alkylene monomers or oligomers, and a remainder of fragrance and dye; and a wick protruding from said solid fuel composition towards said opening.

8. The container candle of claim 7 wherein said synthetic wax comprises polymerized alpha olefins.

9. The container candle of claim 7 wherein said partially hydrogenated soybean oil has an iodine value of at least 49.

10. The container candle of claim 9 wherein said synthetic wax comprises polymerized alpha olefins.

11. The container candle of claim 10 wherein said synthetic wax is formed by exposing alpha olefins to free radical conditions so as to yield polymer products having higher molecular weight, higher viscosities, greater hardness and lower penetrations while also having lower congealing point and melting points than the starting alpha olefin containing material.

12. The container candle of claim 7 wherein said partially hydrogenated soybean oil has an iodine value of 51.

13. The container candle of claim 12 wherein said synthetic wax is formed by exposing alpha olefins to free radical conditions so as to yield polymer products having higher molecular weight, higher viscosities, greater hardness and lower penetrations while also having lower congealing point and melting points than the starting alpha olefin containing material.

14. A solid fuel composition in container candles, votive candles and free-standing candles comprising at least 89 percent of combustible component which is flammable within a wick in the presence of a flame but which will not sustain combustion on a surface independent of said wick, said combustible component consisting of at least 95 percent partially hydrogenated soybean oil which is not fully saturated having an iodine value of between 49 and 53, and 0.001 to 4 percent a synthetic wax formed by polymerizing alpha olefins under free radical conditions to form a highly branched polymer, and 0 to 4 percent a second hydrogenated vegetable or petroleum oil.

15. The solid fuel composition of claim 14 wherein said combustible component consists further of fragrance and dye.

16. The solid fuel composition of claim 15 wherein said combustible component consists further of additives selected from the group of shortening and petroleum jelly.

17. The solid fuel composition of claim 14 wherein said partially hydrogenated soybean oil has an iodine value of approximately 51.

* * * * *